US006612119B2

(12) United States Patent
Eber et al.

(10) Patent No.: US 6,612,119 B2
(45) Date of Patent: Sep. 2, 2003

(54) REFRIGERATION CIRCUIT WITH REHEAT COIL

(75) Inventors: David H. Eber, La Crosse, WI (US); Paul R. Glamm, La Crosse, WI (US); Dwayne L. Johnson, La Crescent, MN (US); Walter Earhart, Jr., La Crosse, WI (US); John F. Klouda, La Crosse, WI (US); Brian J. Kiel, Hudsonville, MI (US); Dale A. Hulst, Grand Rapids, MI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/982,665

(22) Filed: Oct. 18, 2001

(65) Prior Publication Data

US 2002/0023443 A1 Feb. 28, 2002

Related U.S. Application Data

(62) Division of application No. 09/263,391, filed on Mar. 5, 1999, now Pat. No. 6,381,910.

(51) Int. Cl.[7] ..... F25D 17/06; F25B 29/00

(52) U.S. Cl. ..... 62/90; 62/173; 62/509

(58) Field of Search ..... 62/90, 173, 509

(56) References Cited

U.S. PATENT DOCUMENTS

| | | | | |
|---|---|---|---|---|
| 1,837,798 | A | 12/1931 | Shipley | |
| 1,986,863 | A | 1/1935 | Terry | 62/6 |
| 2,107,243 | A | 2/1938 | Gay | 62/6 |
| 2,154,136 | A | 4/1939 | Parcaro | 62/115 |
| 2,172,877 | A | 9/1939 | Parcaro | 62/6 |
| 2,515,842 | A | 7/1950 | Swinburne | 62/6 |
| 2,657,543 | A | 11/1953 | Eichmann | 62/4 |
| 2,961,844 | A | 11/1960 | McGrath | 62/173 |
| 3,105,366 | A | 10/1963 | Atchison | 62/173 |
| 3,139,735 | A | 7/1964 | Malkoff et al. | 62/173 |
| 3,203,196 | A | 8/1965 | Malkoff | 62/173 |
| 3,264,840 | A | 8/1966 | Harnish | 62/173 |
| 3,316,730 | A | 5/1967 | Lauer | 62/173 |
| 3,520,147 | A | 7/1970 | Glackman | 62/173 |
| 3,631,686 | A | 1/1972 | Kautz | 62/173 |
| 4,270,362 | A | 6/1981 | Lancia et al. | 62/173 |
| 4,271,678 | A | 6/1981 | Liebert | 62/173 |
| 4,483,156 | A | 11/1984 | Oudenhoven | 62/324 |
| 4,711,094 | A | 12/1987 | Ares et al. | 62/90 |
| 5,265,433 | A | 11/1993 | Beckwith | 62/90 |
| 5,329,782 | A | 7/1994 | Hyde | 62/90 |
| 5,622,057 | A | 4/1997 | Bussjager et al. | 62/173 |
| 5,651,258 | A | 7/1997 | Harris | 62/90 |

*Primary Examiner*—William Wayner
(74) *Attorney, Agent, or Firm*—William J. Beres; William O'Driscoll

(57) ABSTRACT

A refrigeration system with a high percentage of fresh air. The system comprises a supply air duct; an indoor heat exchange coil operably positioned in the supply air duct; a reheat heat exchange coil operably positioned in the supply air duct; an outdoor heat exchange coil; at least one compressor; and an expansion device. The system also comprises refrigeration system tubing connected to and serially arranging the compressor, the outdoor heat exchange coil, the expansion device and the indoor coil into a refrigeration circuit; and reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil. The system further comprises a subcooler located between and operably connected to the indoor heat exchange coil and the parallel circuited arrangement; and a control valve in the reheat tubing operable to control refrigerant flow through the reheat coil.

35 Claims, 2 Drawing Sheets

FIG. 1
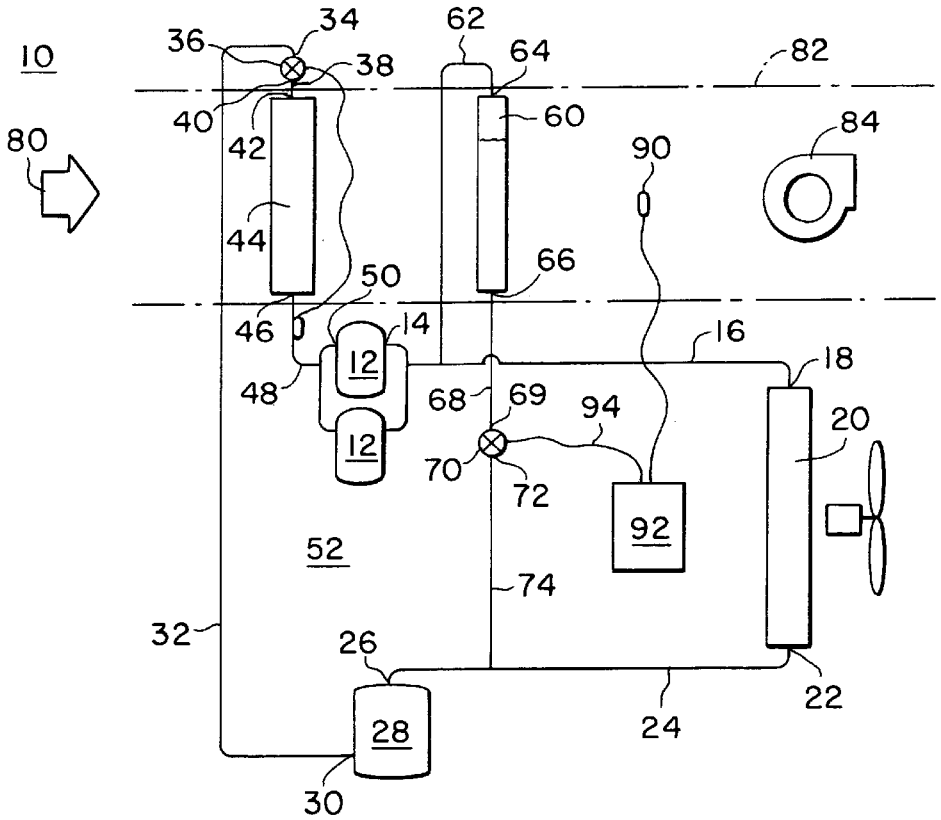
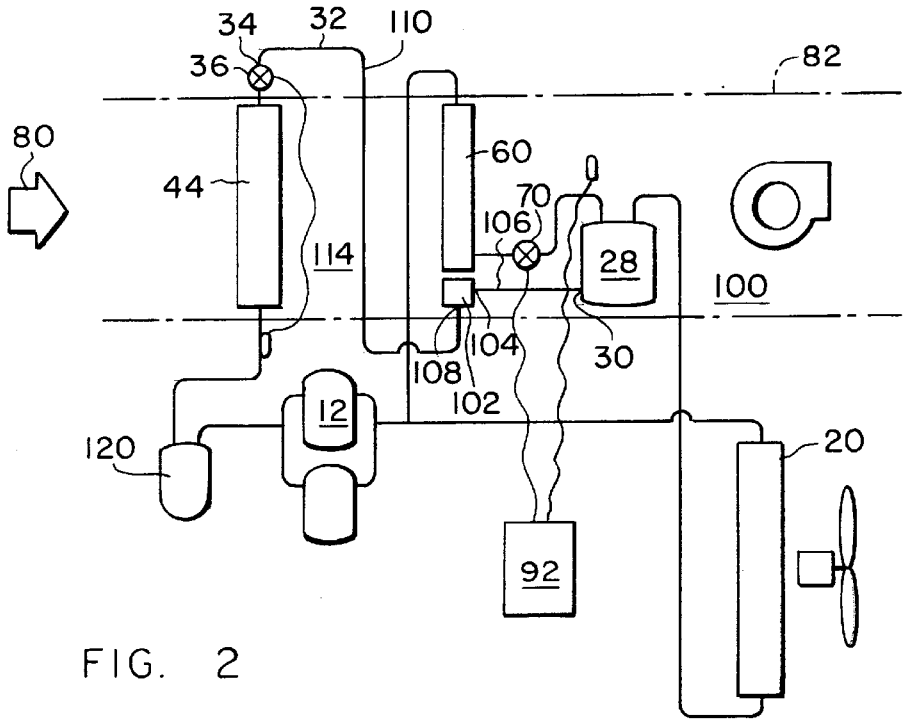
FIG. 2

REFRIGERATION CIRCUIT WITH REHEAT COIL

This is a divisional of application Ser. No. 09/263,391, filed Mar. 5, 1999 now U.S. Pat. No. 6,381,910.

BACKGROUND OF THE INVENTION

The present invention is directed to air conditioning systems which can allow the introduction of a high percentage fresh air into a building in order to comply with indoor air quality standards in an energy efficient manner.

Basically, the present invention focuses on an outdoor air treatment and ventilation system to deliver properly conditioned outdoor air in HVAC systems. The primary benefit in using this type of system is the ability to independently heat, cool and/or dehumidify the outdoor ventilating air.

Poor indoor air quality can pose many risks for the building designer, owner and manager. The quality of the indoor environment can affect the health and productivity of the building occupants and even affect the integrity of the building structure itself. A building's indoor air quality is the result of the activities of a wide variety of individuals over the lifetime of a building, the atmosphere surrounding the building, the building materials themselves, and the way in which the building is maintained and operated. The interaction of these variables make achieving acceptable indoor air quality a complex, multi-faceted problem. Although complex, the fundamental factors which directly influence indoor air quality can be divided into four categories: (a) contaminant source control, (b) indoor relative humidity control, (c) proper ventilation, and (d) adequate filtration.

Ventilation is the process of introducing conditioned outside air into a building for the purpose of diluting contaminants generated within the spaces and of providing makeup air to replace air which is lost to building exhaust. The amount of ventilation air so required is established by building codes and industry standards, and varies with the intended use of the occupied spaces. Most building codes reference ASHRAE Standard 62-89 "Ventilation for Acceptable Indoor Air Quality" either in part or in entirety as a minimum requirement for ventilation system design. This standard is hereby incorporated by reference. ASHRAE Standard 62-89 recommends that "relative humidity in habitable spaces be maintained between 30 and 60 percent to minimize the growth of allergenic and pathogenic organisms". Additionally, indoor relative humidity levels above 60 percent promote the growth of mold and mildew, can trigger allergenic reactions in some people, and have an obvious effect on personal comfort. Extended periods of high humidity can damage furnishings and even damage the building structure itself. Controlling moisture levels within the building and the HVAC system is the most practical way to manage microbial growth.

The increased attention to indoor air quality (IAQ) is causing system designers to look more carefully at the ventilation and humidity control aspects of mechanical system designs particularly including dedicated outdoor air treatment and ventilation systems. These types of systems separate the outdoor air conditioning duties from the recirculated air conditioning duties. The present invention is intended to encompass all air conditioning systems including air handler systems, variable air volume (VAV) systems and constant volume systems.

A problem occurs during the operation of a high percentage fresh air refrigeration unit having a series connected condenser and reheat coil. As cold air from the evaporator is directed over the reheat coil, refrigerant temperature drops and the refrigerant condenses. Hot gas from the compressor flowing through the reheat coil will first give up its superheat. If the refrigerant in the reheat coil is able to be cooled further, the refrigerant will begin to condense. This condensed liquid then flows to the outdoor condenser which has air flowing through the outdoor condenser coil at a higher temperature than the air flowing through the reheat coil. Consequently, the condensed refrigerant may actually re-evaporate, or at least fail to subcool. The result is insufficient subcooling at the expansion valve.

SUMMARY OF THE INVENTION

It is an object, feature and advantage of the present invention to solve the problems of prior art systems.

It is an object, feature and advantage of the present invention to provide an arrangement to reheat cold saturated air to a more comfortable drybulb temperature before being introduced into an inhabited space and to avoid overcooling the space. It is a further object, feature and advantage of the present invention to modulate this reheat using "free" energy from the condensed refrigerant gas in a partially flooded reheat condenser coil.

It is an object, feature and advantage of the present invention to use liquid refrigerant for flooding of a reheat coil piped in parallel with an outdoor condenser coil to control the amount of heat which is rejected to the supply air stream. It is a further object, feature and advantage of the present invention to eliminate separate subcooling sections in the condenser coil and replace those subcooling section with a single subcooler located in the supply air stream. It is a still further object, feature and advantage of the present invention to position the subcooler in the general location of the reheat coil. It is a yet further object, feature and advantage of the present invention to locate the receiver just upstream of the subcooler.

It is an object, feature and advantage of the present invention to provide a reheat coil and an outdoor condenser coil arranged in a parallel refrigerant circuiting arrangement. It is a further object, feature and advantage of the present invention to control the refrigeration system with a modulating liquid valve downstream of the reheat coil. It is an object, feature and advantage of the present invention to provide a retrofit parallel piped hot gas reheat coil. It is a further object, feature and advantage of the present invention to provide subcooling of partially condensed hot gas leaving the hot gas reheat coil and to manage the refrigerant charge required in dehumidification and cooling operating modes. It is a further object, feature and advantage of the present invention to accomplish this using the existing subcooling circuit in the existing condenser coil and by sizing the return piping from the reheat coil in order to match the required charge in the dehumidification mode.

The present invention provides a refrigeration system. The system comprises a supply air duct; an indoor heat exchange coil operably positioned in the supply air duct; a reheat heat exchange coil operably positioned in the supply air duct; an outdoor heat exchange coil; at least one compressor; and an expansion device. The system also comprises refrigeration system tubing connected to and serially arranging the compressor, the outdoor heat exchange coil, the expansion device and the indoor coil into a refrigeration circuit; and reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil. The system also comprises a subcooler located between and operably connected to the indoor heat exchange coil and the parallel circuited arrangement.

The present invention also provides a method of arranging a refrigeration system including an indoor heat exchanger, a reheat coil, an expansion device, an outdoor heat exchanger, and a compressor. The method comprises the steps of: placing the indoor heat exchanger in a supply air stream; placing the reheat coil in the supply air stream; sequentially linking the compressor, the outdoor heat exchanger, the expansion device and the indoor heat exchanger with tubing into a first refrigeration circuit; and linking the reheat coil, with additional tubing, to the first refrigeration circuit so as to place the reheat coil in a series arrangement with the compressor, expansion device, and indoor heat exchanger and in a parallel arrangement with the outdoor heat exchanger.

The present invention further provides a method of controlling reheat in a refrigeration system. The system includes an outdoor coil in parallel arrangement with a reheat coil and includes a flow control valve downstream of the reheat coil. The method comprises the steps of: closing the valve to block flow from the reheat coil thereby causing refrigerant to condense within the reheat coil until the reheat coil is completely filled with liquid; opening the liquid valve slightly to allow refrigerant to flow out of the reheat coil and cause condensation to begin to occur in the reheat coil; and opening the valve completely to expose more coil surface of the reheat coil and cause the reheat coil to be more active in a condensation process.

The present invention additionally provides a refrigeration system. The system comprises a reheat coil; a liquid control valve; and an outdoor coil. The system also comprises first refrigerant tubing operably connected to the outdoor coil, the reheat and the liquid control valve to place the reheat coil and valve in a series arrangement with the valve downstream of the reheat coil and to place the outdoor coil in a parallel arrangement with the reheat coil and the valve.

The present invention still further provides a refrigeration system. The system comprises a supply air duct; an indoor heat exchange coil operably positioned in the supply air duct; a reheat heat exchange coil operably positioned in the supply air duct; an outdoor heat exchange coil; at least one compressor; and an expansion device. The system also comprises refrigeration system tubing connected to and serially arranging the compressor, the outdoor heat exchange coil, the expansion device and the indoor coil into a refrigeration circuit; and reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil. The system further includes a valve in the reheat tubing operable to control refrigerant flow through the reheat coil. A subcooler downstream of the parallel circuited arrangement may also be included.

The present invention yet further provides a method of arranging a refrigeration system including an indoor heat exchanger, a reheat coil, an expansion device, an outdoor heat exchanger, and a compressor. The method comprises the steps of: placing the indoor heat exchanger in a supply air stream; placing the reheat coil in the supply air stream; sequentially linking the compressor, the outdoor heat exchanger, the expansion device and the indoor heat exchanger with tubing into a first refrigeration circuit; linking the reheat coil, with additional tubing, to the first refrigeration circuit so as to place the reheat coil in a series arrangement with the compressor, expansion device, and indoor heat exchanger, and in a parallel arrangement with the outdoor heat exchanger; and using a control valve in the additional tubing to control refrigerant flow from the reheat coil.

BRIEF DESCRIPTION OF THE DRAWINGS

FIG. 1 is a circuit diagram of a refrigeration circuit with a reheat coil and outdoor condenser coil in parallel circuiting arrangement in accordance with the present invention.

FIG. 2 is a alternative embodiment of the present invention in accordance with FIG. 1 with the addition of a subcooler proximal the reheat condenser in the supply air stream.

DETAILED DESCRIPTION OF THE DRAWINGS

Figure 3:
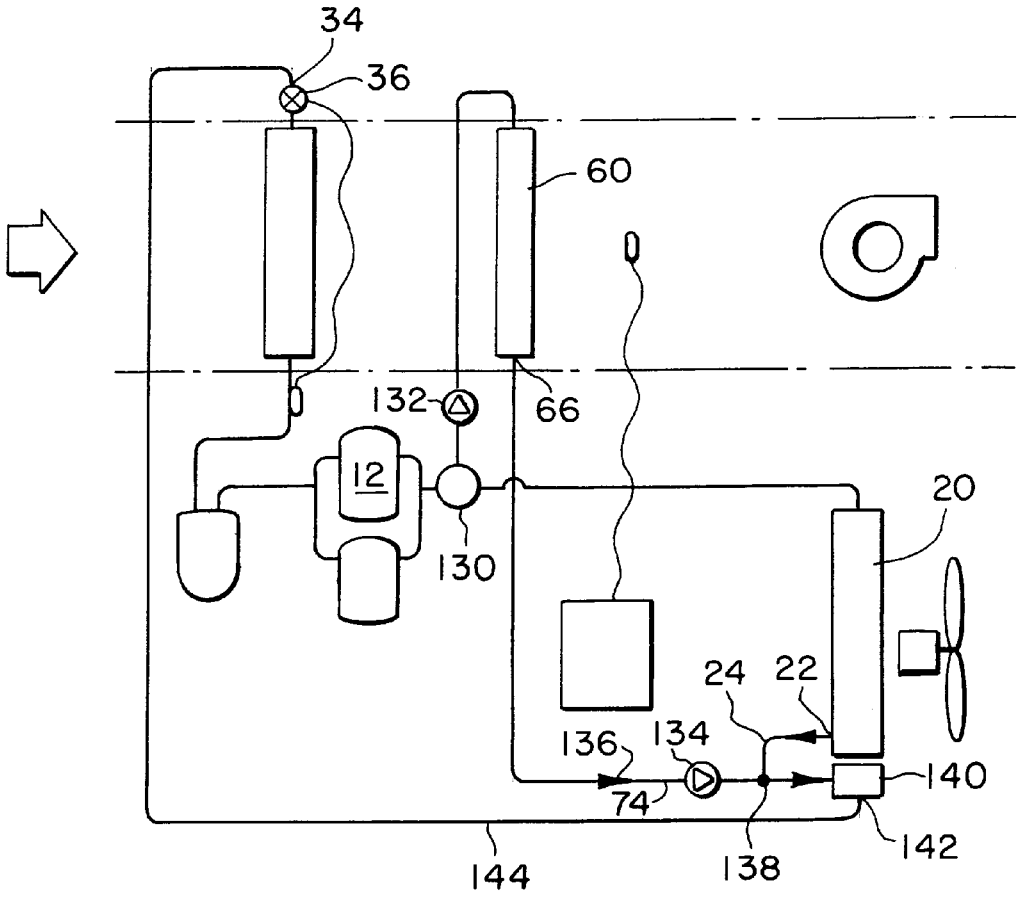
FIG. 3 is a further alternative embodiment of the present invention in accordance with FIG. 1 using the existing subcooler in an outdoor condenser coil.

The present invention is directed to a 100% fresh air conditioning system which provides better indoor air quality than systems using a large percentage of recirculated air. Applicant's co-pending and commonly assigned patent applications entitled "Charge Control for a Fresh Air Refrigeration System" in the name of Brian T. Sullivan as filed on Feb. 12, 1999 and accorded U.S. Ser. No. 09/249,411 now U.S. Pat. No. 6,122,923 to Sullivan issued Sep. 26, 2000; applicant's patent application entitled "Sizing and Control of Fresh Air Dehumidification Unit", also with an inventor Brian T. Sullivan as filed on Jul. 17, 1998, and accorded U.S. Ser. No. 09/118,029 now U.S. Pat. No. 6,170,271 to Sullivan issued Jan. 9, 2001; and applicant's patent application entitled "Integrated Humidity and Temperature controller" in the name of Radhakrishna Ganesh, Thomas J. Clanin and David M. Foye as filed on Jan. 29, 1997 and accorded U.S. Ser. No. 08/790,407, now U.S. Pat. No. 5,915,473 to Ganesh et al. issued Jun. 29, 1999 are hereby incorporated by reference.

FIG. 1 shows an air conditioning system 10 in accordance with the present invention. For purposes of this application, air conditioning system and refrigeration system shall be used interchangeably unless otherwise noted.

The system 10 includes one or more compressors 12 each having a discharge 14 linked by refrigerant tubing 16 to an input 18 of an outdoor heat exchange coil 20. The outdoor heat exchange coil 20 has an output 22 linked by refrigerant tubing 24 to an input 26 of a receiver 28. The receiver 28 has an output 30 linked by refrigeration tubing 32 to an input 34 of an expansion device 36 such as a thermal expansion valve or an electronic expansion valve. The expansion device 36 has an output 38 linked by refrigeration tubing 40 to an input 42 of an indoor heat exchange coil 44. The indoor heat exchange coil 44 has an output 46 linked by refrigeration tubing 48 to an input 50 of the one or more compressors 12. The refrigerant tubing 16, 24, 32, 42 and 48 collectively links the compressor 12, the outdoor heat exchange coil 20, the expansion device 36 and the indoor heat exchange coil 44 into a refrigeration system 52.

The system 10 also includes a reheat coil 60 having an input 64 connected to the compressor discharge 14 by refrigeration tubing 62. The reheat coil 60 has an output 66 connected by refrigeration tubing 68 to an input 69 of a liquid control valve 70. The liquid control valve 70 has an output 72 connected by refrigeration tubing 74 to the refrigeration. tubing 24. The liquid control valve 70 may alternatively be replaced by an on/off solenoid valve which is controlled using stepwise modulation to achieve the same effect. For purposes of this application, the term control valve is intended to encompass the liquid control valve 70, the stepwise modulation of solenoid valves and other equivalents.

The reheat coil 60 and the outdoor heat exchange coil 20 are in a parallel circuiting arrangement in the system 10. Each of the reheat coil 60 and the outdoor heat exchange coil 20 are in a series circuiting arrangement with the compressor 12, the expansion device 36, and the indoor heat exchange coil 44.

The indoor heat exchange coil 44 is operably located in a supply air stream 80 bounded by supply air ducting 82. A supply air fan 84 preferably is provided within the supply air ducting 82 to motivate and control the supply air flow 80. The reheat coil 60 is located in the supply air flow 80 and within the supply air duct work 82 downstream of the indoor heat exchange coil 44. Effectively, the indoor heat exchange coil 44 functions to reduce the temperature and humidity of the supply airstream 80. The reheat coil 60 functions to return the supply air temperature to a desired temperature level as measured by a sensor 90 in the supply air flow 80 downstream of the reheat coil 60.

In operation, the system 10 shown in FIG. 1 provides and modulates reheat using free energy from the condensed refrigerant gas in the reheat coil 60. The amount of refrigerant flow through the reheat coil 60 relative to the flow through the outdoor heat exchange coil 20 is determined by the liquid valve 70 placed at the exit 66 of the reheat coil 60. Since the reheat coil 60 operates in the dehumidified supply airstream 80 downstream of the indoor heat exchange coil 44, the tendency will be for refrigerant to condense in the reheat coil 60 rather than in the outdoor heat exchange coil 20. This is because the dehumidified supply air downstream of the indoor heat exchange coil 44 is at the coldest point in the system 10 and is colder than the air flowing through the outdoor heat exchange coil 20. This tendency is exploited to control the amount of reheat accomplished in the reheat coil 60.

When the liquid valve 70 is completely closed, refrigerant is blocked from flowing through the reheat coil 60 and is instead forced to flow through the outdoor heat exchange coil 20. Since the reheat coil 60 is exposed to cold air from the indoor heat exchange coil 44, refrigerant will condense within the reheat coil 60 until the reheat coil 60 is completely filled with liquid. Heat transfer to the supply airstream 80 from the reheat coil 60 is negligible once the liquid refrigerant in the reheat coil 60 has been subcooled to the supply air temperature. When this occurs, reheat is effectively disabled.

When the liquid valve 70 is opened slightly, liquid refrigerant is allowed to flow out of the reheat coil 60 and condensation will begin to occur within the reheat coil 60. At the same time, refrigerant flow to the outdoor heat exchange coil 20 will be reduced correspondingly. The amount of reheat can be increased by opening the liquid valve 70 further, allowing more of the liquid refrigerant to leave the reheat coil 60 and allowing more of the coil surface of the reheat coil 60 to become active in the condensation process. At maximum reheat, the reheat coil 60 must be properly sized to deliver the maximum required temperature rise to the supply airstream 80 when the reheat coil 60 is on the verge of becoming completely drained of liquid refrigerant.

The amount of reheat can be controlled between the desired minimum and maximum by varying the opening of the liquid valve 70 in response to a proportional control signal generated by a controller 92 and supplied to the valve 70 by an electrical connection line 94. The proportional control signal generated by the controller 92 is modulated based on a comparison of the supply air drybulb temperature measured by the sensor 90 with a setpoint conventional established within the controller 92. Alternative measurements including humidity and wet bulb temperature are contemplated.

Since the volume of liquid contained by the reheat coil 60 varies considerably between the minimum and maximum reheat conditions, the receiver 28 is placed in the refrigerant tubing downstream of both the reheat coil 60 and the outdoor heat exchange coil 20. The receiver 28 is sized large enough to contain all of the volume of refrigerant which can be held within the reheat coil 60 to ensure that all operational modes of the system 10 have sufficient charge.

FIG. 2 shows an alternative embodiment of the present invention where like reference numerals are used for like elements.

In FIG. 2, the receiver 28 is located in the supply airstream 80 in a location 100 which is downstream of the reheat coil 60. Additionally, a subcooler 102 is provided in the supply airstream 80 in a location proximal the reheat coil 60. The subcooler 102 is serially arranged in the refrigeration circuit 52 such that an input 104 of the subcooler 102 is connected by refrigerant tubing 106 to the output 30 of the receiver 28. Additionally, the subcooler 102 has an output 108 connected by refrigerant tubing 110 to the input 34 of the expansion device 36.

The alternative embodiment of FIG. 2 allows subcooling at the expansion device 36 to be reliably maintained over a wide variety of operating conditions. This is accomplished by eliminating separate subcooling sections in the outdoor heat exchange 20 and replacing those separate subcooling sections with the subcooler 102. Additionally, the location of the receiver 28 is now upstream in the refrigeration circuit 52 of the subcooler 102.

In the arrangement of the alternative embodiment of FIG. 2, the refrigerant from both the reheat coil 60 and the outdoor heat exchange coil 20 is routed first to the receiver 28 and then to the subcooler 102. The subcooler 102 is located to be always operating at the lowest temperature air in the system, that air being at a location 114 immediately downstream of the discharge air from the indoor heat exchange coil 44. The subcooler 102 is preferably implemented as an integral section of the reheat coil 60 with separate circuiting but may also be implemented as a separate coil.

The receiver 28 is upstream of the subcooler 102 in the refrigeration circuit 52 to maintain a liquid seal if the temperatures and conditions are such that refrigerant flowing through the outdoor heat exchange coil 20 does not fully condense. The receiver 28 also acts to provide a reservoir of refrigerant charge to supply the system 10 as the reheat coil 60 fills and/or empties with liquid refrigerant during the modulation of the reheat coil by the liquid valve 70.

FIG. 2 also shows a suction accumulator 120 just upstream in the refrigeration circuit 52 of the compressor 12. The suction accumulator 120 may be required if the total amount of system refrigerant charge is greater than specified as acceptable by the compressor manufacturer. The suction accumulator 120 acts to capture excess liquid refrigerant present in the refrigeration tubing under dynamic conditions such as system start-up.

Although the reheat coil 60 can be flooded with liquid refrigerant by closing the liquid valve 70 to thereby modulate the heat transfer of the reheat coil 60 to near zero, the subcooler 102 will always be functioning. This means that the reheat operation cannot be completely turned off. However, since it is not desirable to have wet, nearly saturated air flowing through the duct work 82, some minimum amount of reheat can be tolerated and is actually beneficial from an indoor air quality standpoint.

FIG. 3 is a further alternative embodiment of the present invention where like reference numerals are used for like elements.

In the alternative embodiment of FIG. 3, a threeway valve 130 controls the flow of refrigerant to either the reheat coil 60 or the outdoor heat exchange coil 20. A first check valve 132 is provided upstream of the reheat coil 60 and a second check valve 134 is provided downstream of the reheat coil 60 so as to ensure that refrigerant flow through the reheat coil can only occur in the direction indicated by arrow 136. The discharge 22 from the outdoor heat exchange coil 20 is joined by the discharge 66 of the reheat coil 60 at a point 138 and the combined discharge is directed to a subcooler 140 forming an integral part of the outdoor heat exchange coil 20. The subcooler 140 has a discharge 142 connected by tubing 144 to the input 34 of the expansion device 36.

In operation, the alternative embodiment of FIG. 3 subcools the partially condensed hot gas leaving the reheat coil 60 and equalizes the refrigerant charge required in both cooling and dehumidification operating modes. This is accomplished by using the subcooling circuit 140 typically provided in an outdoor heat exchange coil 20 and by sizing the returned piping 74 from the reheat coil 60 in order to match the required charge in the dehumidification mode to the standard factory provided refrigerant charge used in the conventional cooling mode.

What has been described is a refrigeration system which can use 100% fresh air to supply the air conditioning needs of a building. It will be apparent to a person of ordinary skill in the art that many modifications and alterations are apparent. Such modifications include employing a separate modulating reheat circuit which also contains a main but separate DX dehumidification circuit or separate chilled water dehumidification coil upstream of the indoor heat exchange coil and the reheat coil. Other modifications include the type of heat exchange coils used in the system as well as modifications of the valve 70. All such modifications and alterations are intended to fall within the spirit and scope of the claimed invention.

What is desired to be secured by Letters Patent of the United States is set forth in the following claims.

What is claimed is:

1. A refrigeration system comprising:

a supply air duct;

an indoor heat exchange coil operably positioned in the supply air duct;

a reheat heat exchange coil operably positioned in the supply air duct;

an outdoor heat exchange coil;

at least one compressor;

an expansion device;

refrigeration system tubing connected to and serially arranging the compressor, the outdoor heat exchange coil, the expansion device and the indoor coil into a refrigeration circuit;

reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil; and a subcooler located between and operably connected to the indoor heat exchange coil and the parallel circuited arrangement.

2. The refrigeration system of claim 1 wherein the subcooler is located in physical proximity to the outdoor heat exchange coil.

3. The refrigeration system of claim 2 further including receiver tubing downstream of the subcooler wherein the receiver tubing is sized a greater diameter than the system tubing and reheat tubing.

4. The refrigeration system of claim 1 wherein the subcooler is located in the supply air duct in physical proximity to the reheat coil.

5. The refrigeration system of claim 4 further including a refrigerant receiver operably connected to the refrigeration system tubing between the subcooler and the parallel circuited arrangement.

6. The refrigeration system of claim 5 further including a control valve in the reheat tubing operable to control refrigerant flow through the reheat coil.

7. The refrigeration system of claim 6 wherein the valve is a liquid flow control valve located between the receiver and the reheat coil.

8. A refrigeration system comprising:

a supply air duct;

an indoor heat exchange coil operably positioned in the supply air duct;

a reheat heat exchange coil operably positioned in the supply air duct;

an outdoor heat exchange coil;

at least one compressor;

an expansion device;

refrigeration system tubing connected to and serially arranging the compressor, the outdoor heat exchange coil, the expansion device and the indoor coil into a refrigeration circuit;

reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil; and a valve in the reheat tubing operable downstream of the reheat coil and to control refrigerant flow through the reheat coil.

9. The refrigeration system of claim 8 wherein the valve is a liquid flow control valve located between the receiver and the reheat coil.

10. The refrigeration system of claim 9 further including a subcooler located between and operably connected to the indoor heat exchange coil and the parallel circuited arrangement.

11. The refrigeration system of claim 10 wherein the subcooler is located in the supply air duct in physical proximity to the reheat coil.

12. The refrigeration system of claim 11 further including a refrigerant receiver operably connected to the refrigeration system tubing between the subcooler and the parallel circuited arrangement.

13. The refrigeration system of claim 8, wherein the subcooler is located in physical proximity to the outdoor heat exchange coil, and further including receiver tubing downstream of the subcooler wherein the receiver tubing is sized a greater diameter than the system tubing and reheat tubing.

14. A method of arranging a refrigeration system including an indoor heat exchanger, a reheat coil, an expansion device, an outdoor heat exchanger, and a compressor comprising the steps of:

placing the indoor heat exchanger in a supply air stream;

placing the reheat coil in the supply air stream;

sequentially linking the compressor, the outdoor heat exchanger, the expansion device and the indoor heat exchanger with tubing into a first refrigeration circuit;

linking the reheat coil, with additional tubing, to the first refrigeration circuit so as to place the reheat coil in a series arrangement with the compressor, expansion device, and indoor heat exchanger, and in a parallel arrangement with the outdoor heat exchanger; and placing a subcooler in the refrigeration circuit between the expansion device and the parallel arrangement.

15. The method of claim 14 including the further step of locating the subcooler in the supply air stream proximal the reheat coil.

16. The method of claim 14 including the further step of locating the subcooler proximal the outdoor heat exchanger.

17. The method of claim 16 including the further steps of positioning check valves in the additional tubing upstream and downstream of the reheat coil so as to limit flow through the reheat coil to a single direction.

18. The method of claim 14 including the further step of adding a receiver between the subcooler and the parallel arrangement.

19. A method of arranging a refrigeration system including an indoor heat exchanger, a reheat coil, an expansion device, an outdoor heat exchanger, and a compressor comprising the steps of:

placing the indoor heat exchanger in a supply air stream;

placing the reheat coil in the supply air stream;

sequentially linking the compressor, the outdoor heat exchanger, the expansion device and the indoor heat exchanger with tubing into a first refrigeration circuit;

linking the reheat coil, with additional tubing, to the first refrigeration circuit so as to place the reheat coil in a series arrangement with the compressor, expansion device, and indoor heat exchanger, and in a parallel arrangement with the outdoor heat exchanger;

placing a subcooler in the refrigeration circuit between the expansion device and the parallel arrangement; and using a control valve in the additional tubing to control refrigerant flow from the reheat coil.

20. The method of claim 19 including the further step of locating the subcooler in the supply air stream proximate the reheat coil.

21. The method of claim 19, including the further step of locating the subcooler proximal the outdoor heat exchanger.

22. The method of claim 21 including the further step of adding a receiver between the subcooler and the parallel arrangement.

23. A refrigeration system comprising:

a reheat coil;

a control valve;

an outdoor coil;

first refrigerant tubing operably connected to the outdoor coil, the reheat and the control valve to place the reheat coil and valve in a series arrangement with the control valve downstream of the reheat coil and to place the outdoor coil in a parallel arrangement with the reheat coil and the control valve.

24. The refrigeration system of claim 23 further including:

an indoor heat exchange coil operably connected in series with the parallel arrangement and the control valve; and a subcooler and operably connected by second refrigerant tubing between the indoor heat exchange coil and the parallel arrangement.

25. The refrigeration system of claim 24 wherein the subcooler is located in physical proximity to the outdoor heat exchange coil.

26. A refrigeration system comprising:

a supply air duct;

an indoor heat exchange coil operably positioned in the supply air duct;

a reheat heat exchange coil operably positioned in the supply air duct;

an outdoor heat exchange coil;

at least one compressor;

an expansion device;

refrigeration system tubing connected to and serially arranging the compressor, the outdoor heat exchange coil, the expansion device and the indoor coil into a refrigeration circuit;

reheat tubing connecting the reheat coil to the refrigeration tubing so as to arrange the reheat coil in a parallel circuited arrangement with the outdoor heat exchange coil and in a series circuited arrangement with the compressor, the expansion device and the indoor heat exchange coil;

a subcooler located between and operably connected to the indoor heat exchange coil and the parallel circuited arrangement; and a control valve in the reheat tubing operable to control refrigerant flow through the reheat coil.

27. An HVAC or refrigeration circuit comprising:

a first airstream;

a second airstream;

a reheat coil positioned in the first airstream and exchanging heat between a heat transfer fluid in the reheat coil and air in the first airstream;

an outdoor heat exchange coil positioned in the second airstream and exchanging heat between the heat transfer fluid in the outdoor heat exchange coil and air in the second airstream;

a heat transfer system linking the reheat coil and the outdoor coil in a parallel arrangement and providing the heat transfer fluid thereto and receiving the heat transfer fluid therefrom; and a control valve included in the heat transfer system downstream of the reheat coil and associated with the reheat coil to control the flow of heat transfer fluid through the reheat coil and including a first condition where the control valve is closed and heat transfer does not flow through the reheat coil and heat transfer between the air and the fluid becomes negligible and including a second condition where the control valve is open and heat transfer between the heat transfer fluid in the reheat coil and the air in the first airstream occurs as a function of the degree that the control valve is open.

28. The system of claim 27 further including a receiver in the heat transfer system located downstream of both the reheat and the outdoor heat exchange coils.

29. The system of claim 28 wherein the subcooler is located in the first airstream.

30. The system of claim 29 wherein the receiver has an outlet, the subcooler has an inlet, and the receiver outlet and the subcooler inlet are connected to allow the passage of heat transfer fluid therebetween.

31. The system of claim 30 wherein the subcooler includes an outlet and the heat transfer system includes an expansion device operably connected to the outlet of the subcooler.

32. The system of claim 31 wherein the reheat coil is sized to provide a maximum required temperature rise in the first airstream when the control valve is at a fully open position.

33. The system of claim 22 wherein the reheat coil is sized to provide a maximum required temperature rise in the first airstream when the control valve is at a fully open position.

34. The system of claim 33 further including a controller operably controlling the position of the control valve and modifying said control valve based upon the difference between the temperature and the temperature setpoint.

35. An HVAC or refrigeration circuit comprising:

a first airstream;

a second airstream;

a reheat coil positioned in the first airstream and exchanging heat between a heat transfer fluid in the reheat coil and air in the first airstream;

an outdoor heat exchange coil positioned in the second airstream and exchanging heat between the heat transfer fluid in the outdoor heat exchange coil and air in the second airstream;

a heat transfer system linking the reheat coil and the outdoor coil in a parallel arrangement and providing the heat transfer fluid thereto and receiving the heat transfer fluid therefrom; and a control valve included in the heat transfer system downstream of the reheat coil and associated with the reheat coil to control the flow of heat transfer fluid through the reheat coil and including a first condition where the control valve is closed and heat transfer does not flow through the reheat coil and heat transfer between the air and the fluid becomes negligible and including a second condition where the control valve is open and heat transfer between the heat transfer fluid in the reheat coil and the air in the first airstream occurs as a function of the degree that the control valve is open.

* * * * *

UNITED STATES PATENT AND TRADEMARK OFFICE

CERTIFICATE OF CORRECTION

PATENT NO. : 6,612,119 B2
DATED : September 2, 2003
INVENTOR(S) : David H. Eber et al.

It is certified that error appears in the above-identified patent and that said Letters Patent is hereby corrected as shown below:

Title page,
Item [62], Related U.S. Application Data, "6,381,910" should read -- 6,381,970 --.

Column 1,
Line 5, "6,381,910" should read -- 6,381,970 --.

Column 5,
Line 3, "eration." should read -- eration --.

Column 11,
Line 17, "22" should read -- 27 --.

Signed and Sealed this

Sixth Day of January, 2004

JAMES E. ROGAN
*Director of the United States Patent and Trademark Office*

UNITED STATES PATENT AND TRADEMARK OFFICE

CERTIFICATE OF CORRECTION

PATENT NO. : 6,612,119 B2
DATED : September 2, 2003
INVENTOR(S) : David H. Eber et al.

It is certified that error appears in the above-identified patent and that said Letters Patent is hereby corrected as shown below:

Column 12,
Line 24, "open." should read -- open; --.
Line 25, insert the following:

-- further including a receiver in the heat transfer system located downstream of both the reheat and the outdoor heat exchange coils;
-- wherein the receiver is sized to hold a refrigerant volume equal to or greater than a refrigerant volume capacity of the reheat coil. --

Signed and Sealed this

Seventh Day of September, 2004

JON W. DUDAS
*Director of the United States Patent and Trademark Office*